United States Patent [19]

Colliver

[11] Patent Number: 4,599,042

[45] Date of Patent: Jul. 8, 1986

[54] FAN CASING VOLUTE

[75] Inventor: Anthony D. Colliver, St. Marys, Australia

[73] Assignee: Coolair Corporation Pte., Ltd., Singapore, Singapore

[21] Appl. No.: 611,688

[22] Filed: May 18, 1984

[30] Foreign Application Priority Data

May 18, 1983 [AU] Australia ..... PF9417

[51] Int. Cl.[4] ..... F03B 11/02

[52] U.S. Cl. ..... 415/204; 415/200; 415/219 R; 285/319

[58] Field of Search ..... 415/204, 200, 219 R, 415/219 B, DIG. 5; 403/376, 377, 261, 349; 285/DIG. 22, 319, 331, 423, 289; 384/537, 539, 584, 442, 443, 444, 441, 439, 428, 585, 536, 582; 308/DIG. 11

[56] References Cited

U.S. PATENT DOCUMENTS

| | | | |
|---|---|---|---|
| 2,116,539 | 5/1938 | Payne et al. | 415/127 |
| 3,367,108 | 2/1968 | Camboulives | 415/219 R |
| 3,376,084 | 4/1968 | McKee | 384/536 |
| 3,394,660 | 7/1968 | Ohmann et al. | 415/200 |
| 3,403,843 | 10/1968 | Cox | 415/219 R |
| 3,407,995 | 10/1968 | Kinsworthy | 415/204 |
| 3,415,500 | 12/1968 | Pethis | 384/536 |
| 3,469,772 | 9/1969 | McDonald | 415/204 |
| 3,698,833 | 10/1972 | Cann et al. | 415/204 |
| 4,017,128 | 4/1977 | Setele et al. | 384/536 |
| 4,026,581 | 5/1977 | Pasbrig | 285/319 |
| 4,275,907 | 6/1981 | Hunt | 285/319 |

FOREIGN PATENT DOCUMENTS

| | | | |
|---|---|---|---|
| 464380 | 4/1950 | Canada | 415/219 R |
| 638502 | 6/1950 | United Kingdom | 384/539 |
| 993711 | 6/1965 | United Kingdom | 415/9 |

*Primary Examiner*—Edward K. Look
*Assistant Examiner*—John Kwon
*Attorney, Agent, or Firm*—Henry Sternberg; Bert J. Lewen

[57] ABSTRACT

A fan casing volute comprises two half members which are joined to one another, each half member being formed by a moulding process from a polymeric material, the volute being characterized by central bearing housings in intake openings of the volute end plates, and a plurality of U-shaped arms which support the bearing housings, all being in a single monolithic moulding, and all having substantially similar cross-sectional thicknesses.

3 Claims, 5 Drawing Figures

FAN CASING VOLUTE

Figure 2:
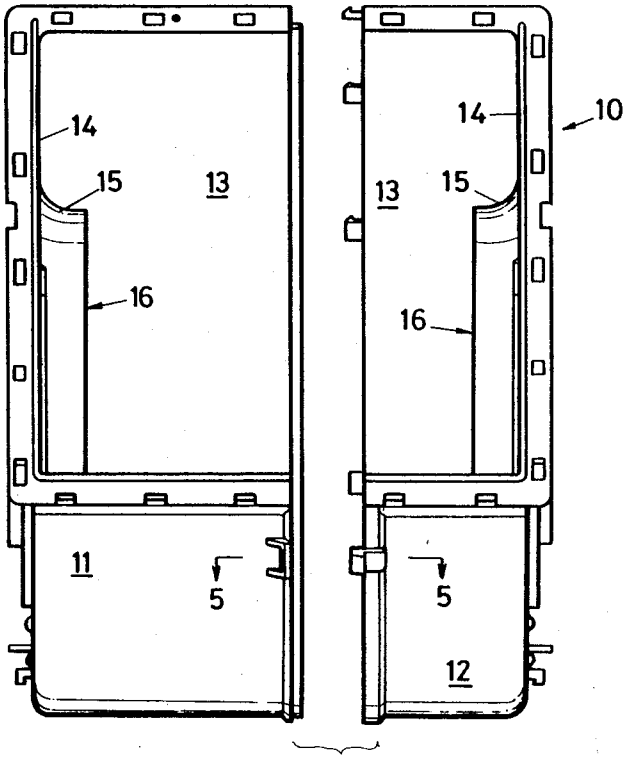

This invention relates to improvements in a volute, or scroll, of a fan of the centrifugal blower type.

BACKGROUND OF THE INVENTION

With the general improvement in plastics materials, it has become customary to produce a fan volute from moulded plastics material, usually in two halves which are interconnected, and to provide a plurality of radiating arms carrying the bearings for the central shaft of the impeller (see for example our Australian Pat. No. 536805). The shaft is usually journalled in bearings which are supported in a bearing housing carried by the radiating arms, and having a ring of elastomeric material interposed to absorb the high frequency vibrations.

However in the moulding of plastics material, difficulty is sometimes encountered due to the large co-efficient of expansion of the material, and the fact that the material is hot when moulded. Consequently variation of wall thickness can result in distortion of shape when a moulded plastic part of large size and relatively thin wall is cooling after having been moulded. Accordingly it has been the custom in the past to utilise metal radiating arms secured to securing pads on the fan casing volute by fasteners, the most commonly used fasteners being metal thread screws and nuts. While this overcomes a distortion problem, it introduces a secondary problem in that high stress areas are created at the localities of the fasteners.

One object of this invention therefore is to provide improvements in fan casing volutes wherein difficulties due to differential contraction of the plastics material, and difficulties due to high stress areas, are substantially reduced.

BRIEF SUMMARY OF THE INVENTION

In one embodiment of this invention, a fan casing volute comprises two half members which are joined to one another, each half member being formed by a moulding process from a polymeric material, the volute being characterised by central bearing housings in intake openings of the volute end plates, and a plurality of U-shaped arms which support the bearing housings, all being in a single monolithic moulding, and all having substantially similar cross-sectional thicknesses.

With this invention not only is it possible to overcome the abovementioned difficulties, but it is also possible to produce a volute which is lower in cost.

While many so-called "solid" mouldings are very responsive to differential contraction after moulding, dense foam polymeric material has the capacity to retain its shape better and shrink with less distortion, even though the ultimate tensile strength of the material may be less. Thus in one embodiment of the invention the material used is a polymeric material containing a foaming agent when moulding which, upon cooling, solidifies to form a relatively dense foam between substantially imperforate skins. One such material is polypropylene, another, rigid polyurethane.

When a radiating arm is used to support a bearing housing of a centrifugal type fan, it is necessary that the thickness of the arm should not be so great as to interfere with the air flow into the fan, but if substantially constant thickness of material is to be used, a thin flat arm would be much too pliable and much too weak to support a bearing housing, but since each said radiating arm is of general U-shape in cross-section, there is provided sufficient mechanical strength without greatly thickening the wall thickness.

More specifically, the invention consists of two volute portions, and means joining the volute portions to form a volute assembly, each said volute portion being a monolithic moulding of polymeric material and comprising an end plate with surfaces defining an air intake aperture, a hollow bearing housing in the aperture, and a plurality of arms extending outwardly from the bearing housing to the end plate thereby supporting the bearing housing from the end plate, each said arm being of U-shape in cross-section, the thickness of the polymeric material in each said volute portion being substantially constant throughout each respective said portion.

Figure 1:
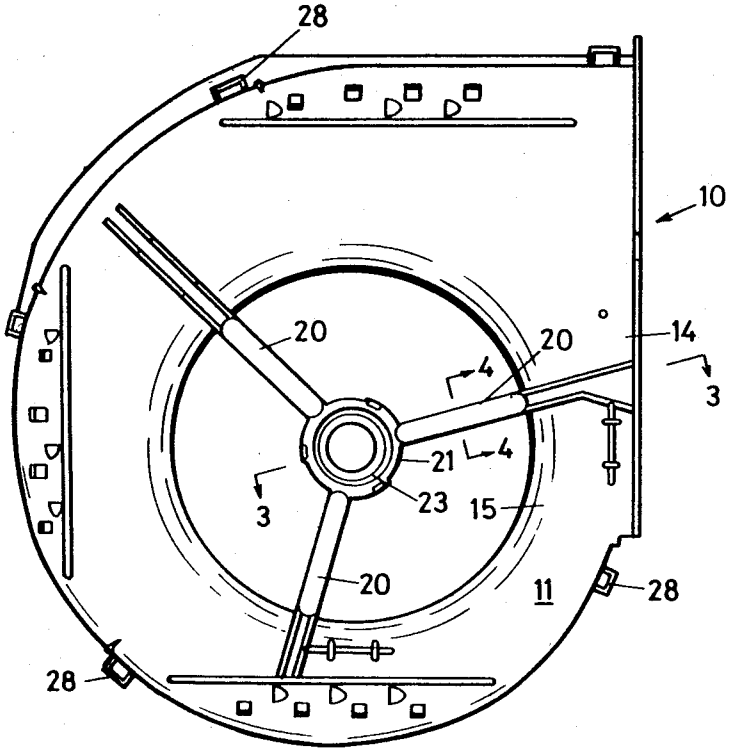
Figure 3:
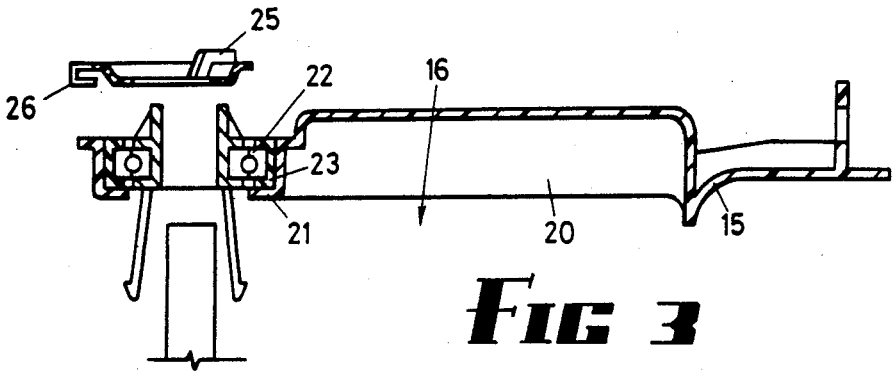
Figure 4:
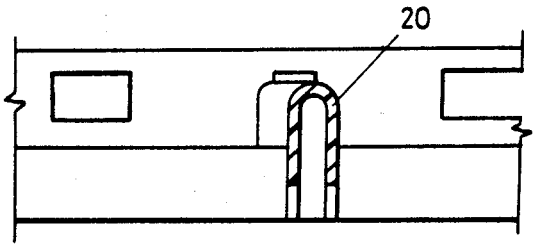
Figure 5:
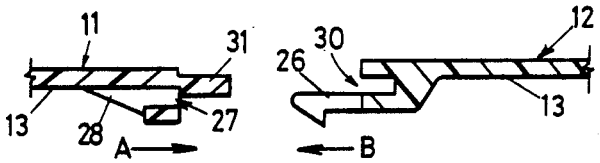

An embodiment of the invention is described hereunder in some detail with reference to, and is illustrated in the accompanying drawings in which:

FIG. 1 is a side elevation of a fan volute,

FIG. 2 is an end elevation of same, illustrating two volute portions about to be joined, FIG. 3 is a section taken on line 3—3 of FIG. 1, drawn to an enlarged scale, and illustrating a bearing housing and a supporting arm therefor, FIG. 4 is a cross-section through said supporting arm, taken on line 4—4 of FIG. 1, and FIG. 5 is a section which illustrates the means which join two volute portions end to end.

In this embodiment a fan casing volute 10 (or scroll), comprises two portions 11 and 12 which are joined together in a plane normal to the axis of rotation of the fan impeller.

Each is formed as a monolithic moulding, and has a part spiral outer casing wall 13 which merges through a radius into a respective end wall 14, each end wall 14 curved inwardly to provide an aerofoil surface 15 surrounding an air intake aperture 16 for air which is incoming into the fan volute 10.

At each end there are provided three equally spaced radiating arms 20 which at the inner ends support a hollow bearing housing 21, and at their outer ends merge into the end walls 14. The radiating arms extend across some or all the width of the end walls 14.

Each radiating arm is of general U-section as shown in FIG. 4, and of substantially the same thickness as the remainder of the moulding. This avoids differential contraction problems which can otherwise result in excessive distortion.

To still further reduce distortion, the wall thickness of the moulding is considerable, the moulding comprising a dense foam sandwiched between two impervious skins, providing a dimensionally stable structure much less likely to distort than a so-called "solid" moulding, and wherein much of the stress which results from cooling is relieved by the foam core of the moulding. This greatly reduces misalignment of the bearing housings. As shown in FIG. 3, each bearing 22 is supported by the housing 21 and has interposed between the outer shell of the bearing and the housing, an annular ring 23 of elastomeric material (for example rubber), and the need to machine any parts is avoided. The bearing 22 and ring 23 are retained by a bearing retainer 25 with circumferentially spaced lugs 26. Since the moulding is monolithic for each respective half of the volute, it is possible to reduce the stress concentration to be much less than exists when metal arms are used, and by utilising a U-section for the radiating arms, the face presented to the incoming air can be curved so that there is a minimum of disturbance or turbulence imparted to that air, this being a matter of some importance. However this shape provides the arms with the required stiffness and strength to safely support the bearings for normal operation.

The means for joining the volute portions 11 and 12 together are shown in FIG. 5. Volute portion 12 has projecting from it laterally, a plurality of barbed tongues 26 which engage receiving sockets 27 in lugs 28 outstanding from spaced points around the periphery of portion 11, and assembly is effected by lateral movement in direction of arrows A and B in FIG. 5. Further, the joining means comprises surfaces defining a curved slot 30 extending at least part way around the end of the part spiral wall 13 of portion 12, and a tongue 31 projecting laterally from the other part spiral wall 13 which projects into slot 30 and engages the surfaces thereof upon assembly of the two portions.

I claim:

1. Improvements in a fan volute of a fan of the centrifugal blower type which comprises two volute portions, and means joining the volute portions to form a volute assembly, each said volute portion being a monolithic moulding of polymeric material of dense foam sandwiched between impervious skins, and comprising an end plate with surfaces defining an air intake aperture, a hollow bearing housing in the aperture, and a plurality of arms extending outwardly from the bearing housing to the end plate thereby supporting the bearing housing from the end plate, each said arm being of generally U-shape in cross-section, the thickness of the polymeric material in each said volute portion being substantially constant throughout each respective said portion including throughout each said arm of generally U-shaped cross-section each said volute portion further having a bearing in the bearing housing, an annular ring of elastomeric material surrounding the bearing and engaging an inner surface of the bearing housing, and a bearing retainer retaining the bearing in the bearing housing, each said volute portion further having a cooperating boyonet lugs on the retainer and bearing housing.

2. Improvements according to claim 1 wherein each said volute portion comprises a part spiral wall which extends in a curved lateral direction away from the end plate of that volute portion, said joining means comprising a plurality of barbed tongues projecting laterally from the part spiral wall of one of said volute portions engaging in receiving sockets in the part spiral wall of the other of said volute portions for locking said volute portions to each other in axial alignment.

3. Improvements according to claim 1 wherein said joining means comprises surfaces defining a slot in an end of one of said part spiral walls, and a tongue projecting laterally from the other of said part spiral walls which projects into said slot and engages the surfaces thereof for locking said volute portions to each other in axial alignment.

* * * * *